US006182298B1

(12) United States Patent
Dampney

(10) Patent No.: US 6,182,298 B1
(45) Date of Patent: Feb. 6, 2001

(54) LATCHING DEVICE FOR ATTACHING A BREATHING MASK TO A HELMET

(75) Inventor: Ian Trevor Dampney, London (GB)

(73) Assignee: Helmet Integrated Systems Ltd., Hertfordshire (GB)

( * ) Notice: Under 35 U.S.C. 154(b), the term of this patent shall be extended for 0 days.

(21) Appl. No.: 08/669,574

(22) Filed: Jun. 24, 1996

(30) Foreign Application Priority Data

May 24, 1996 (GB) ..... 9610883

(51) Int. Cl.[7] ..... A42B 3/04

(52) U.S. Cl. ..... 2/422; 292/5; 292/10; 24/584; 24/607

(58) Field of Search ..... 2/410, 422, 424, 2/6.1, 6.2, 6.3; 292/5, 10; 128/201.22, 201.24, 205.25, 206.12, 206.21, 206.24, 206.27, 207.11; 24/581, 584, 625, 607

(56) References Cited

U.S. PATENT DOCUMENTS

| | | | | |
|---|---|---|---|---|
| 2,867,812 | * | 1/1959 | Roth et al. | 2/6.2 |
| 3,035,573 | * | 5/1962 | Morton, Jr. et al. | 2/6.2 |
| 4,084,298 | | 4/1978 | Fohl | 24/230 |
| 4,208,771 | | 6/1980 | Biller | 24/230 |
| 4,625,371 | | 12/1986 | Ueda | 24/641 |
| 4,648,138 | * | 3/1987 | Brigden et al. | 2/6.3 |
| 4,803,980 | * | 2/1989 | Nowakowski et al. | 2/6.2 |

FOREIGN PATENT DOCUMENTS

| | | |
|---|---|---|
| 652513 | 4/1951 | (GB) . |
| 2179092 | 2/1987 | (GB) . |
| 2287745 | 9/1995 | (GB) . |

* cited by examiner

*Primary Examiner*—Michael A. Neas
(74) *Attorney, Agent, or Firm*—Hodgson, Russ, Andrews, Woods & Goodyear LLP

(57) ABSTRACT

A latching device eg for attaching a breathing mask to an aircrew helmet, has detents (20) on a receptacle portion (10), and teeth (32) on carriers (30,31) supported for arcuate movement in an insert portion (14) and supported (eg at 33) so that bending loads on the carriers are substantially avoided.

14 Claims, 1 Drawing Sheet

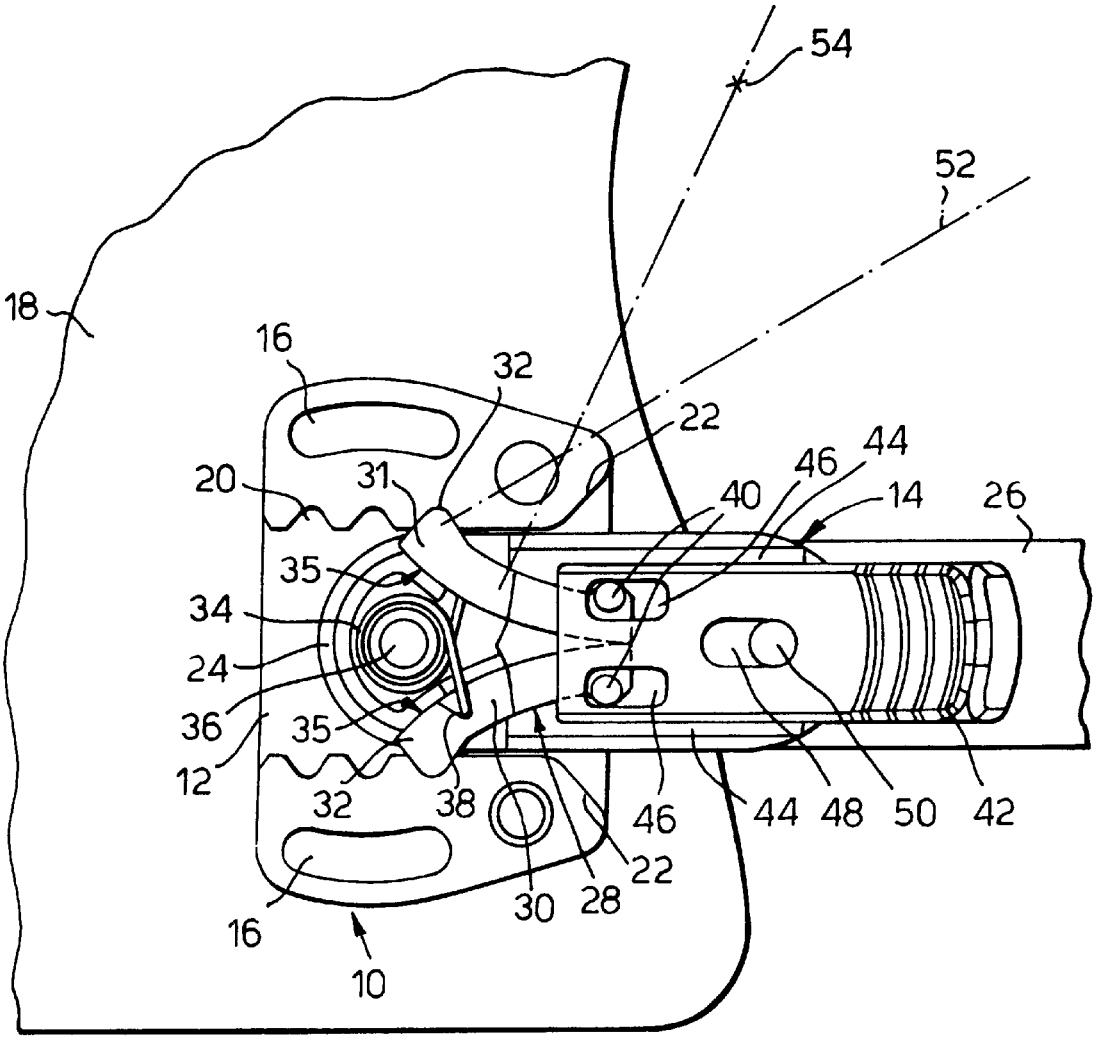
54
52
18
16
32
22
20
31
44
46
40
14
26
35
34
24
36
35
12
32
38
46
44
48
50
42
22
30
28
16
10

LATCHING DEVICE FOR ATTACHING A BREATHING MASK TO A HELMET

This invention relates to a latching device, preferred embodiments of which are for use in attaching a breathing mask to a helmet for example as used by military aircrew.

Known helmet and breathing mask assemblies employ two-part latches one on each side of the helmet. One part of each latch, a receptacle, is fixed to the helmet and the other, an insert, is attached to a strap of the breathing mask so that when the latches are assembled the mask is held to the wearer's face.

The service requirements of these latches are demanding. They must be capable of fast and positive engagement so that the wearer can fit his mask quickly, they must be robust to withstand rough handling, and they must not come undone under any likely service condition.

These requirements have led to prior art latches being of metal construction and of considerable length, with the result that the end of the latch projects, causing a potential snagging hazard for parachute lines.

These latches embody pivoted levers on the insert portion, carrying teeth which engage detents on the receptacle. Positive latching depends on forces being transmitted through the length of the levers to the teeth, and sometimes these levers fail in service due to the bending stresses imposed upon them.

At least the preferred embodiments of the present invention are directed to avoiding these problems of the prior art.

In one aspect the invention provides a latching device comprising first and second portions slidably receivable one in the other, the portions having detachably engageable parts for latching the portions together, one said part being carried on its said portion by a carrier member and being arranged to abut fixed structure of said portion so that in-service loads are transmitted to the fixed structure without being transmitted to the carrier member, the one detachably engaged part being slidable on said fixed structure to effect disengagement.

In another aspect the Invention provides a latching device comprising first and second portions slidably receivable one in the other, the portions having detachably engageable parts for latching the portions together, one said part being carried by a carrier member moveable along an arcuate path to disengage said parts, the detachably engageable parts having conforming contacting surfaces disposed relative to the centre of revolution of said arcuate path to resist separation of the first and second portions.

Resistance to separation is achieved in a preferred embodiment by arranging that a normal to the conforming contacting surfaces passes between said path and the said centre of revolution thereof.

The said one part may be supported by a said first or second portion so that latching forces are not transmitted to the carrier member.

The carrier member may be disposed in a groove defining the said arcuate path.

The device may comprise a release member for applying a force to the carrier member substantially tangentially to the arcuate path to disengage said parts.

The release member may be slidably mounted on a said portion.

There may be means for limiting the travel of the release member.

Preferably there are means for displacing the carrier member along the arcuate path to permit the first and second portions to be received one in the other.

A preferred embodiment has two oppositely-facing sets of engageable parts disposed one set on each side of the first and second portions.

There may be common resilient means for biasing the engageable parts of each set into engagement.

The detachably engageable parts may be a tooth and a detent.

There may be a plurality of detents permitting the first and second portions to be latched in different relative positions.

The first portion may be a receptacle and the second portion an insert receivable therein.

The first portion may comprise means for attaching it to a helmet, and the second portion may comprise means for attaching it to a strap of a breathing mask.

The invention also includes a helmet and mask assembly comprising a latching device as set forth above.

The invention will now be described merely by way of example with reference to the accompanying drawing.

A latching device comprises a first or receptacle portion 10 having a channel 12 in which a second or insert portion 14 (described hereafter) is received. The portion 10 is generally plate-like in form and has arcuate slots 16 on a common centre to permit it to be fixed by rivets or bolts to the cheek area of a helmet, a portion of which is shown diagrammatically at 18.

The sides of the channel 12 are formed as a series of detents or recesses 20, and the entry end of the channel is chamfered at 22 on each side to form a lead-in for the insertion of the insert portion 14.

A cover (not shown in the drawing, for reasons of clarity, fits over the receptacle portion 10 and is held in position by the rivets or bolts employed to fasten the portion 10 to the helmet. The channel 12 then forms a recess or pocket, in which the portion 14 may be inserted and removed only by sliding movement in the plane of the drawing. The cover can conveniently be a second receptacle portion, identical to the portion 10 and inverted with respect thereto.

The insert portion 14 has a body 24 the cross-sectional dimensions of which enable it to slide snugly in the channel 12 of the receptacle portion 10. The body 24 is attached by rivets (not shown) to the end of a strap 26 forming part of a breathing mask.

The body has defined therein two oppositely-facing arcuate grooves or, channels 28 in which are slidably disposed respective arcuate carrier members 30, 31. The grooves extend to the sides of the body 24; the carrier members 30, 31 project outwardly therefrom, and terminate in teeth 32 which conform to a shape of the detents 20.

A coil torsion spring 34 mounted on a boss 36 engages notches 38 in the carrier members 30 and 31. The notch in the carrier 31 is on its underside and thus cannot be seen, but is similar to that in carrier 30. The spring 34 is wound and pre-loaded such that its ends apply a force substantially tangentially of the grooves so that when the insert 14 is in the receptacle 10 the teeth 32 are biased into engagement with the detents 20. The use of a common spring 34 for both carriers ensures that both teeth 32 are urged equally into engagement. The inner edges of the grooves 38 are notched locally to permit the passage of the ends of the spring 34 but otherwise constrain the carriers 30, 31 to arcuate movement. In particular, portion 35 of the grooves abut the rear of the teeth 32, and provide fixed reaction points for in-service loads taken by the teeth 32, as described hereafter.

The ends of the carriers 30, 31 remote from the teeth 32 each have a projecting stud 40. A release slide 42 is slidable longitudinally to the body 24 between side walls 44 thereof.

The slide 42 has slots 46 into which the studs 40 are received, and a further slot 48 which receives a further stud 50.

Operation of the latching device will now be described. When it is required to connect the latching portions 10, 14 together the insert portion 14 is presented to the entry end of the receptacle 10. The chamfers 22 engage the flanks of the teeth 32 forming the ends of the carriers 30, 31 and cause the carriers to move inwardly along their grooves, permitting the insert to enter the receptacle. When the teeth 32 reach the detents 20 they move outwardly under the action of the spring 34. The tightness of the breathing mask on the wearers face is adjusted by pushing the insert further inwards so that the required pair of detents 20 are engaged. The flanks of the detents 20 apply a substantially circumferential displacing force to the ends of the carriers 30, 31 in the same way as the chamfers 22 to achieve this. The length of the slot 48 in such that excessive leftward movement of the release slide is prevented by the stud 50 if the wearer uses excessive force to release the mechanism. This could happen if the wearer seeks to remove the mask rapidly in an emergency.

The flanks of the teeth 32 facing towards the entrance to the receptacle, and the flanks of the detents which they engage, are planar and such that a line 52 normal to the tooth flank passes between the carrier 30 or 31 and the virtual centre 54 of the carrier.

The tooth flank thus is angled inwards relative to the concave side of the carrier 30, 31. This ensures that axial tension as applied to the insert 14 during use tends to promote engagement of the tooth with the detent rather than loosen it. The force on the tooth due to the axial tension passes trough the tooth to the rear face thereof where it is transmitted to the part 35 of the wall of groove 28. Thus bending loads on the carriers 30, 31 and teeth 32 are avoided and the latching device is less susceptible than prior an devices to failure of the teeth or the parts carrying them.

To disconnect the latching portions 10, 14 movement of the release slide 42 to the right in the drawing causes the ends of the slots 46 to engage the studs 40 and apply a substantially circumferential force to the carriers 30, 31 to slide them along the surfaces of the grooves 28, 35 to withdraw the teeth 32 from the detents 20. The insert 14 can then be pulled out of the receptacle 10.

When disconnecting, the flank of each tooth slides up the ramp constituted by the corresponding face of the detent, the insert portion 14 moving slightly to the left in the drawing to accommodate this. The other face of the tooth and the detent are relieved at an appropriate angle to permit the disengagement.

Because of the manner in which service loads are transmitted through the latching device, the receptacle 10, insert portion 14, carries 30, 31 and release slide 42 all can be manufactured by injection moulding in an impact resilient plastics material such as nylon or a polyacetal (eg polyoxymethylene).

Furthermore when latched the insert 14 does not project beyond the rear (left hand and in the drawing) of the receptacle, thereby avoiding a potential snagging point for parachute lines.

Each feature disclosed in this specification (which term includes the claims) and/or shown in the drawings may be incorporated in the invention independently of other disclosed and/or illustrated features.

To summarise, a latching device e.g. for attaching a breathing mask to an aircrew helmet, has detents (20) on a receptacle portion (10), and teeth (32) on carriers (30, 31) supported for arcuate movement in an insert portion (14) and supported (e.g. at 35) so that bending loads on the carriers are substantially avoided.

What is claimed is:

1. A latching device comprising first and second portions slidably receivable one in the other for connection to components of an arrangement which are to be held together, the portions having respective parts detachably engageable with each other for latching the portions together, one said detachably engageable part being carried on the second portion by a carrier member and being arranged to abut fixed structure of said first portion so that in-service loads are transmitted to the fixed structure without being transmitted to the carrier member, the one detachably engageable part being slidable on said fixed structure to effect disengagement, there being two oppositely-facing sets of engageable parts disposed one set on each side of the first and second portions.

2. A latching device as claimed in claim 1 comprising common resilient means for biasing the engageable parts of each set into engagement.

3. A latching device comprising first and second portions slidably receivable one in the other, the portions having respective parts detachably engageable with each other for latching the portions together, one said detachably engageable part being carried on the second portion by a carrier member and being arranged to abut fixed structure of said portion so that in-service loads are transmitted to the fixed structure without being transmitted to the carrier member, the one detachably engageable part being slidable on said fixed structure to effect disengagement, the said one part being supported by a said portion so that latching forces are not transmitted to the carrier member, the carrier member being disposed in a groove defining said arcuate path.

4. A latching device comprising first and second portions slidably receivable one in the other, the portions having respective parts detachably engageable with each other for latching the portions together, a carrier member carrying said one detachably engageable part, means defining an arcuate path having a center of revolution, the carrier member being slidably movable along said arcuate path to disengage said parts, the detachably engageable parts having conforming contacting surfaces disposed relative to the center of revolution of said arcuate path to resist separation of the first and second portions, the said one part being supported by a said portion so that latching forces are not transmitted to the carrier member, the carrier member being disposed in a groove defining said arcuate path.

5. A latching device comprising first and second portions slidably receivable one in the other, the portions having respective parts detachably engageable with each other for latching the portions together, a carrier member carrying one said detachably engageable part, means defining an arcuate path having a center of revolution, the carrier member being slidably movable along said accurate path to disengage said parts, the detachably engageable parts having conforming contacting surfaces disposed relative to the center of revolution of said arcuate path to resist separation of the first and second portions, and a release member for applying a force to the carrier member substantially tangentially to the arcuate path to disengage said parts.

6. A latching device as claimed in claim 5 herein the release member is slidably mounted on a said portion.

7. A latching device as claimed in claim 6 comprising means for limiting the travel of the release member.

8. A latching device comprising first and second portions slidably receivable one in the other, the portions having respective parts detachably engageable with each other for latching the portions together, a carrier member carrying one said detachably engageable part, means defining an arcuate path having a center of revolution, the carrier member being slidably movable along said arcuate path to disengage said parts, the detachably engageable parts having conforming contacting surfaces disposed relative to the center of revolution of said arcuate path to resist separation of the first and second portions, there being two oppositely-facing sets of engageable parts disposed one set on each side of the first and second portions.

9. A latching device as claimed in claim 8 comprising common resilient means for biasing the engageable parts of each set into engagement.

10. A latching device comprising first and second portions slidably receivable one in the other, the portions having respective parts detachably engageable with each other for latching the portions together, one said detachably engageable part being carried on the second portion by a carrier member and being arranged to abut fixed structure of said first portion so that in-service loads are transmitted to the fixed structure without being transmitted to the carrier member, the one detachably engageable part being slidable on said fixed structure to effect disengagement, the detachably engaging parts being a tooth and a detent, there being a plurality of detents permitting the first and second portions to be latched in different relative positions.

11. A latching device comprising first and second portions slidably receivable one in the other, the portions having respective parts detachably engageable with each other for latching the portions together, a carrier member carrying one said detachably engageable part, means defining an arcuate path having a center of revolution, the carrier member being slidably movable along said arcuate path to disengage said parts, the detachably engageable parts having conforming contacting surfaces disposed relative to the center of revolution of said arcuate path to resist separation of the first and second portions, the detachably engageable parts being a tooth and a detent, there being a plurality of detents permitting the first and second portions to be latched in different relative positions.

12. A latching device comprising first and second portions slidably receivable one in the other, the first portion being a receptacle and the second portion being an insert receivable therein, the portions having respective parts detachably engageable with each other for latching the portions together, one said detachably engageable part being carried on the second portion by a carrier member and being arranged to abut fixed structure of said first portion so that in-service loads are transmitted to the fixed structure without being transmitted to the carrier member, the one detachably engageable part being slidable on said fixed structure to effect disengagement.

13. A helmet and breathing mask assembly comprising a latching device comprising first and second portions slidably receivable one in the other, the portions having respective parts detachably engageable with each other for latching the portions together, one said detachably engageable part being carried on the second portion by a carrier member and being arranged to abut fixed structure of said first portion so that in-service loads are transmitted to the fixed structure without being transmitted to the carrier member, the one detachably engageable part being slidable on said fixed structure to effect disengagement.

14. A helmet and breathing mask assembly comprising a latching device comprising first and second portions slidably receivable on in the other, the portions having respective parts detachably engageable with each other for latching the portions together, a carrier member carrying one said detachably engageable part, means defining an arcuate path having a center of revolution, the carrier member being slidably movable along said arcuate path to disengage said parts, the detachably engageable parts having conforming contracting surfaces disposed relative to the center of revolution of said arcuate path to resist separation of the first and second portion.

* * * * *